United States Patent [19]

Ishii

[11] Patent Number: 5,067,562

[45] Date of Patent: Nov. 26, 1991

[54] HEAT EXCHANGER HAVING FINS WHICH ARE DIFFERENT FROM ONE ANOTHER IN FIN THICKNESS

[75] Inventor: Yutaka Ishii, Isesaki, Japan

[73] Assignee: Sanden Corporation, Gunma, Japan

[21] Appl. No.: 343,816

[22] Filed: Apr. 25, 1989

[30] Foreign Application Priority Data

Apr. 25, 1988 [JP] Japan ..... 63-54562[U]

[51] Int. Cl.[5] ..... F28F 13/00

[52] U.S. Cl. ..... 165/146; 165/150

[58] Field of Search ..... 165/146, 150

[56] References Cited

U.S. PATENT DOCUMENTS 2,376,749 5/1945 Belaieff ..... 165/146

3,223,152 12/1965 Schulenberg ..... 165/146

FOREIGN PATENT DOCUMENTS 60-175992 9/1985 Japan .

63-5270 1/1988 Japan .

*Primary Examiner*—Allen J. Flanigan

*Attorney, Agent, or Firm*—Banner, Birch McKie & Beckett

[57] ABSTRACT

In a heat exchanger having a plurality of fins mounted on an outer surface of a tube which is for conducting a fluid therethrough, the fins are different in fin thickness to make a first and a second fin set portion. Each of the fins of the first fin set portion has a comparatively small thickness. Each of the fins of the second fin set portion has a comparatively large thickness. The heat exchanger is placed in another fluid so that a comparatively high flow energy portion of the other fluid flows into the first fin set portion while another comparatively low flow energy portion of the other fluid flows into the second fin set portion.

3 Claims, 2 Drawing Sheets

HEAT EXCHANGER HAVING FINS WHICH ARE DIFFERENT FROM ONE ANOTHER IN FIN THICKNESS

BACKGROUND OF THE INVENTION

This invention relates to heat exchangers which are for carrying out heat exchange between fluids, such as gas or a liquid.

In order to carry out heat exchange between a first and a second fluid, a conventional heat exchanger comprises a tube and a plurality of fins mounted on an outer surface of the tube. The fins are for contacting with the first fluid flowing through gaps between the fins. The tube is for conducting the second fluid therethrough.

The first fluid generally flows with a flow energy distribution within a lateral section of the flow thereof. In the flow energy distribution, it is assumed that the first fluid has portions which are different from one another in flow energy. This results in reduction of efficiency of the heat exchange in comparison with a case where the first fluid would have a uniform flow energy within the section of the flow.

In order to improve the efficiency of the heat exchange, various heat exchangers of the type are already known. A known heat exchanger is disclosed in, for example, JP-A-60-175992.

In the known heat exchanger, a tube is formed in a serpentine-anfractuous shape to have a plurality of tube portions arranged parallel with one another with spaces left therebetween. Fins are formed to have a thickness and are disposed in each of the spaces. The spaces are designed with reference to the flow energy distribution and therefore one of the spaces is different in size from another. However, it is difficult to manufacture the heat exchanger because the tube must be bent to define spaces of different sizes.

JP-A-60-175992 also discloses another example of the heat exchanger wherein fin pitches are designed different between a fin set portion and another fin set portion with reference to the flow energy distribution. However, it is difficult to manufacture the heat exchanger because it is very complicated to fix the fins onto the tube with various fin pitches.

Another heat exchanger is disclosed in JP-U-63-5270, wherein fins extend in a flowing direction of the first fluid with different extensions from one another with reference to the above-mentioned flow energy distribution. However, this results in reduction of ability of the heat exchange in the heat exchanger.

SUMMARY OF THE INVENTION

It is therefore an object of the present invention to provide a heat exchanger which is capable of effectively carrying out heat exchange and is easy in production.

Other objects of this invention will become clear as the description proceeds.

According to this invention, there is provided a heat exchanger for use in a first fluid to carry out heat exchange between the first fluid and a second fluid. The heat exchanger comprises a tube for conducting the second fluid therethrough and a plurality of fins mounted on an outer surface thereof for contacting with the first fluid flowing through gaps between the fins. The first fluid has a flow energy distribution within a lateral section of the flow of the first fluid. The fins are different in fin thickness to make a first fin set portion wherein fins have a comparatively large thickness and a second fin set portion wherein fins have a comparatively small thickness. The first and second fin set portions are arranged within the lateral section of the flow of the first fluid so that a comparatively high flow energy portion of the first fluid flows into the first fin set portion while another comparatively low flow energy portion of the first fluid flows into the second fin set portion.

DESCRIPTION OF THE PREFERRED EMBODIMENT

Figure 1:
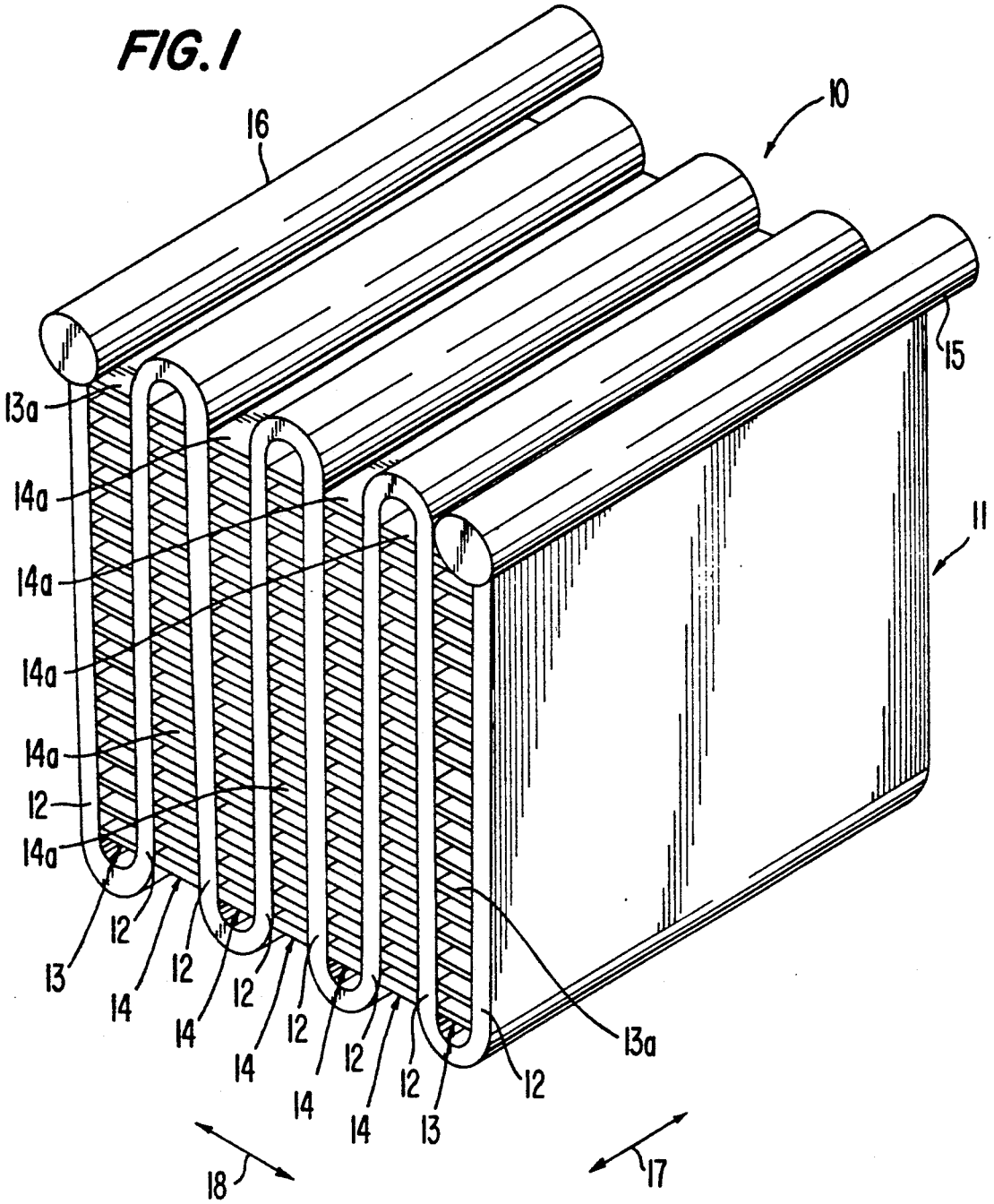
FIG. 1 is a perspective view of a heat exchanger according to an embodiment of this invention.

Referring to FIG. 1, a heat exchanger 10 according to an embodiment of the present invention is of a typical serpentine-type and comprises a flat metal tube 11. Flat tube 11 has one or more refrigerant passageways (which are omitted from FIG. 1 for simplification of the figure) therein and is formed in a serpentine-anfractuous shape to have a plurality of tube portions 12, as described hereinbefore. Each refrigerant passageway serves to conduct a refrigerant. Tube portions 12 are arranged parallel with one another with spaces left therebetween.

A plurality of fin units 13 and 14 are disposed in the spaces, respectively, and are joined to the tube portions 12. Two fin units 13 are disposed at opposite sides of heat exchanger 10 and each of them will hereafter be called an end fin set portion. Each of the remaining fin units 14 will hereafter be called an intermediate fin set portion.

An inlet header pipe 15 is mounted on an end of flat tube 11 to introduce the refrigerant fed through a refrigerant feeder pipe (not shown) to the refrigerant passageways of the flat tube. An outlet header pipe 16 is mounted on the other end of flat tube 11 to lead the refrigerant passing through the flat tube into a refrigerant return pipe (not shown).

End fin set portion 13 has a plurality of fins 13*a* mounted on outer surfaces of tube portions 12 to define particular passages therebetween. Intermediate fin set portion 14 has a plurality of fins 14*a* mounted on the outer surfaces of tube portions 12 to define normal passages therebetween. Each of fins 13*a* and 14*a* extends between adjacent ones of tube portions 12 in a first direction 17 and a second direction 18 which is perpendicular to first direction 17.

Each of fins 13*a* of end fin set portion 13 has a comparatively small thickness of, for example, 0.1 to 0.16 mm. Each of fins 14*a* of intermediate fin set portion 14 has a comparatively large thickness of, for example, 0.13 to 0.3 mm. As a result, each of the particular passages is slightly larger than each of the normal passages in sectional area thereof in second direction 18. It is to be noted in this connection that end and intermediate fin set portions 13 and 14 have fins 13*a* and 14*a* equal to one another in number. In other words, fins 13*a* and 14*a* are arranged with a predetermined pitch in each of end and intermediate fin set portions 13 and 14.

Figure 2:
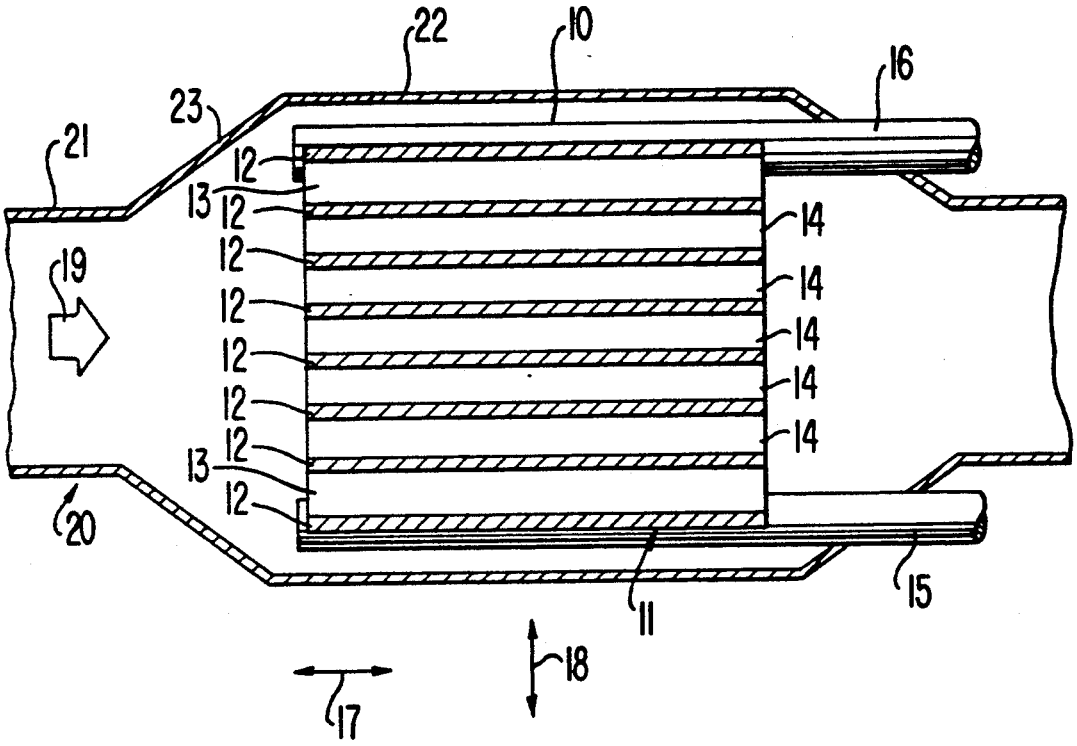
FIG. 2 shows, together with a duct, a longitudinal sectional view of the heat exchanger illustrated in FIG. 1.

Referring to FIG. 2 in addition, heat exchanger 10 is used together with a duct 20. Duct 20 is for conducting air which is generated by a blower (not shown). The air is sent along an arrow 19. In this event, the air has a flow energy distribution within a lateral section of the flow thereof as will later be clear.

Duct 20 has first, second, and third portions 21, 22, and 23. First portion 21 defines width taken along second direction 18. Second portion 22 defines another space having width taken along second direction 18 wherein the width of the space defined by second portion 22 is greater than the width of the space defined by first portion 21. Third portion 23 connects the first and second portions 21 and 22 and has side walls extending to intersect first direction 17, that is, diverge towards second portion 22 from first portion 21. Heat exchanger 10 is placed in second portion 22 so that end fin set portions 13 are disposed near to side walls of second portion 22, respectively.

The air flows into third portion 23 through first portion 21. In third portion 23, it is assumed that the air has a high flow energy portion, namely, a normal part at the center thereof in second direction 18 and a low flow energy portion, namely, a particular part which is present at both sides of the center in second direction 18 and which is lower than the normal part in flow energy.

Subsequently, the air flows into heat exchanger 10 so that the normal part flows into each of the normal passages and that the particular part flows into each of the particular passages. Flowing speed of the air is even or equal in all of the passages in spite of the particular part being lower than the normal part in the flow energy. This is because each of fins 13*a* of end fin set portions 13 has the comparatively small thickness as clearly described before.

Therefore, the heat exchange is effectively carried out between the air, namely, the first fluid and the refrigerant as a second fluid.

While the present invention has thus far been described in connection with only one embodiment thereof, it will readily be possible for those skilled in the art to put this invention into practice in various other manners. For example, a selected one of the intermediate fin set portions may be designed with reference to the flow energy distribution of the first fluid so that each of fins has the comparatively small thickness. It is a matter of course that the duct may have a shape which is modified. The present invention is applicable to various kinds of heat exchanger without being limited to the serpentine-type.

What is claimed is:

1. A heat exchanger for carrying out heat exchange between a first fluid and a second fluid, said heat exchanger comprising a tube for conducting said second fluid therethrough and a plurality of fins mounted on an outer surface in contact with said first fluid flowing through gaps between said fins, said first fluid having a flow energy distribution within a lateral section of the flow of said first fluid, wherein said plurality of fins have different fin thicknesses including a first set of fins having a comparatively large thickness and a second set of fins having a comparatively small thickness, said first and said second sets of fins being arranged within said lateral section of the flow of the first fluid so that a comparatively high flow energy portion of said first fluid flows into said first set of fins while another comparatively low flow energy portion of the first fluid flows into said second set of fins, said fins being arranged with a predetermined pitch in each of said first and second sets of fins.

2. A heat exchanger as claimed in claim 1, wherein said first fluid flows in a first direction and has a normal part and a particular part which is lower than said normal part in the flow energy to form said flow energy distribution within a section perpendicular to said first direction, and wherein said tube comprises a plurality of tube portions spaced apart from one another in a second direction which is perpendicular to said first direction, each of said tube portions defining at least one fluid passageway for conducting said second fluid, said fins of the first set of fins being fixedly disposed between first adjacent ones of said tube portions and extending in said first and second directions to define said gaps as normal passages therebetween so that said normal part flows into each of said normal passages, said fins of the second set of fins being fixedly disposed between second adjacent ones of said tube portions and extending in said first and said second directions to define said gaps as particular passages therebetween so that said particular part of the flow energy distribution flows into each of said particular passages, each of said particular passages being larger than each of said normal passages in a sectional area thereof in said second direction.

3. A heat exchanger apparatus including a heat exchanger for carrying out heat exchange between a first and a second fluid and a duct having first, second and third portions, said heat exchanger being adapted to fit inside said second portion of said duct, wherein said first portion of said duct defines a space having a width in a direction lateral to the flow of the first fluid through said duct, said second portion defines another space having a width which is larger than the width in the lateral direction of the space defined by said first portion and said third portion connects the first and second portions, said heat exchanger comprises:

a tube for conducting said second fluid therethrough, wherein said tube has a plurality of fins mounted on an outer surface thereof in contact with said first fluid flowing through gaps between said fins, said first fluid having a flow energy distribution within a lateral section of the flow of said first fluid in said duct;

said fins have a different fin thickness such that a first set of fins has fins having a comparatively large thickness compared to a second set of fins wherein the fins have a comparatively small thickness;

said first and second sets of fins are arranged within said lateral section of flow of the first fluid in said duct, such that a comparatively high flow energy portion of said first fluid flows into said first set of fins while another comparatively low flow energy portion of the first fluid flows into said second set of fins; and said fins being arranged with a predetermined pitch in each of said first and said second set of fins whereby the flowing speed of the first fluid is equal in both the first and second sets of fins in the heat exchanger.

* * * * *